United States Patent [19]

Beebe

[11] Patent Number: 4,844,550

[45] Date of Patent: Jul. 4, 1989

[54] WEAR PROTECTOR FOR TOOTH BRACKETS ON ROADWAY SURFACE CUTTING MACHINES

[76] Inventor: Donald E. Beebe, Box 464, Wapato, Wash. 98931

[21] Appl. No.: 194,181

[22] Filed: May 16, 1988

Related U.S. Application Data

[63] Continuation-in-part of Ser. No. 76,544, Jul. 21, 1987, abandoned.

[51] Int. Cl.[4] ..... E21C 25/12

[52] U.S. Cl. ..... 299/92; 299/86

[58] Field of Search ..... 299/86, 79, 91, 92; 237/142 R

[56] References Cited

U.S. PATENT DOCUMENTS

| | | | |
|---|---|---|---|
| T103,602 | 11/1983 | Rettkowski | 299/10 |
| 3,512,838 | 5/1968 | Kniff | 299/86 |
| 3,746,396 | 7/1973 | Radd | 299/86 X |
| 3,752,515 | 8/1973 | Oaks et al. | 299/86 |
| 3,796,464 | 3/1974 | Hansen et al. | 299/86 |
| 3,830,321 | 8/1974 | McKenry et al. | 299/86 X |
| 3,841,708 | 10/1974 | Kniff et al. | 299/86 |
| 3,865,437 | 2/1975 | Crosby | 299/86 |
| 3,957,307 | 5/1976 | Varda | 299/86 |
| 4,084,856 | 4/1978 | Emmerich et al. | 299/86 |
| 4,201,421 | 5/1980 | Den Besten et al. | 299/86 |
| 4,247,150 | 1/1981 | Wrulich et al. | 299/86 |
| 4,302,053 | 11/1981 | Roepke et al. | 299/86 |
| 4,333,687 | 6/1982 | Barnstorf | 299/81 |
| 4,335,921 | 6/1982 | Swisher, Jr. et al. | 299/86 |
| 4,489,986 | 12/1984 | Dziak | 299/86 |
| 4,561,698 | 12/1985 | Beebe | 299/86 |
| 4,583,786 | 4/1986 | Thorpe et al. | 299/92 X |

OTHER PUBLICATIONS

All Pacific Distribution Brochure, 3-1987.

*Primary Examiner*—Thuy M. Bui
*Assistant Examiner*—David J. Bagnell
*Attorney, Agent, or Firm*—Wells, St. John & Roberts

[57] ABSTRACT

Disclosed is a bushing and wear protector apparatus which rotatably mounts a wear tooth within a bracket socket on a roadway surface cutting machine. A first member of the apparatus rotatably receives a shank of the wear tooth. A second member of the apparatus protects an exposed face of the bracket for preventing wear. The first and second members each rotatably receive the wear tooth and are prevented from rotating relative to each other and the bracket.

19 Claims, 4 Drawing Sheets

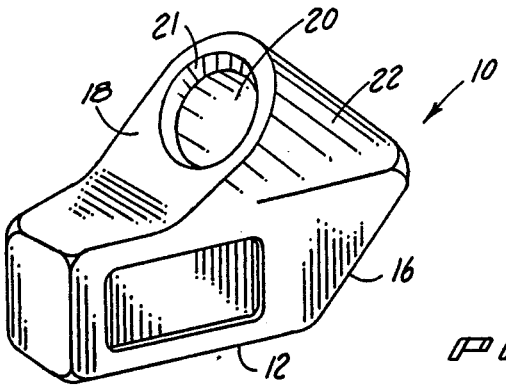
FIG 1
PRIOR ART
FIG 2
PRIOR ART
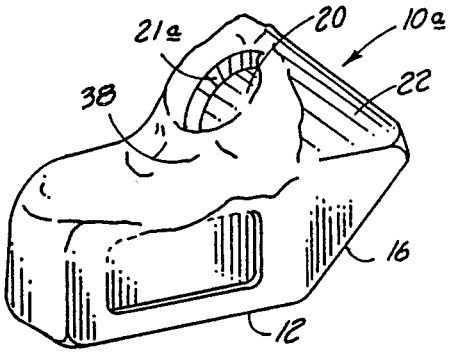
FIG 3
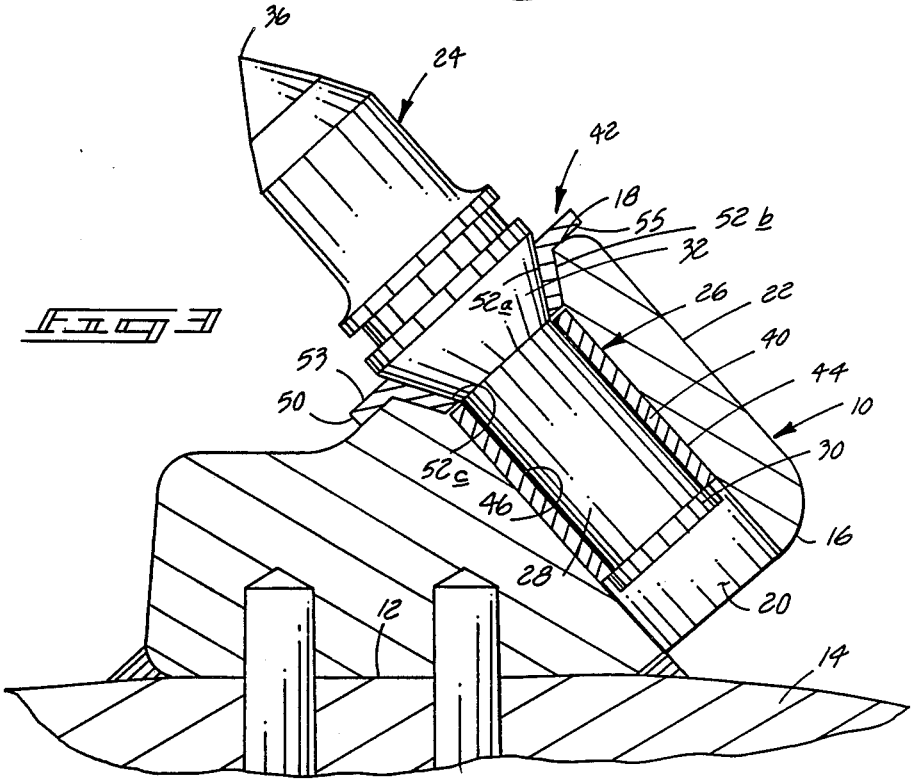

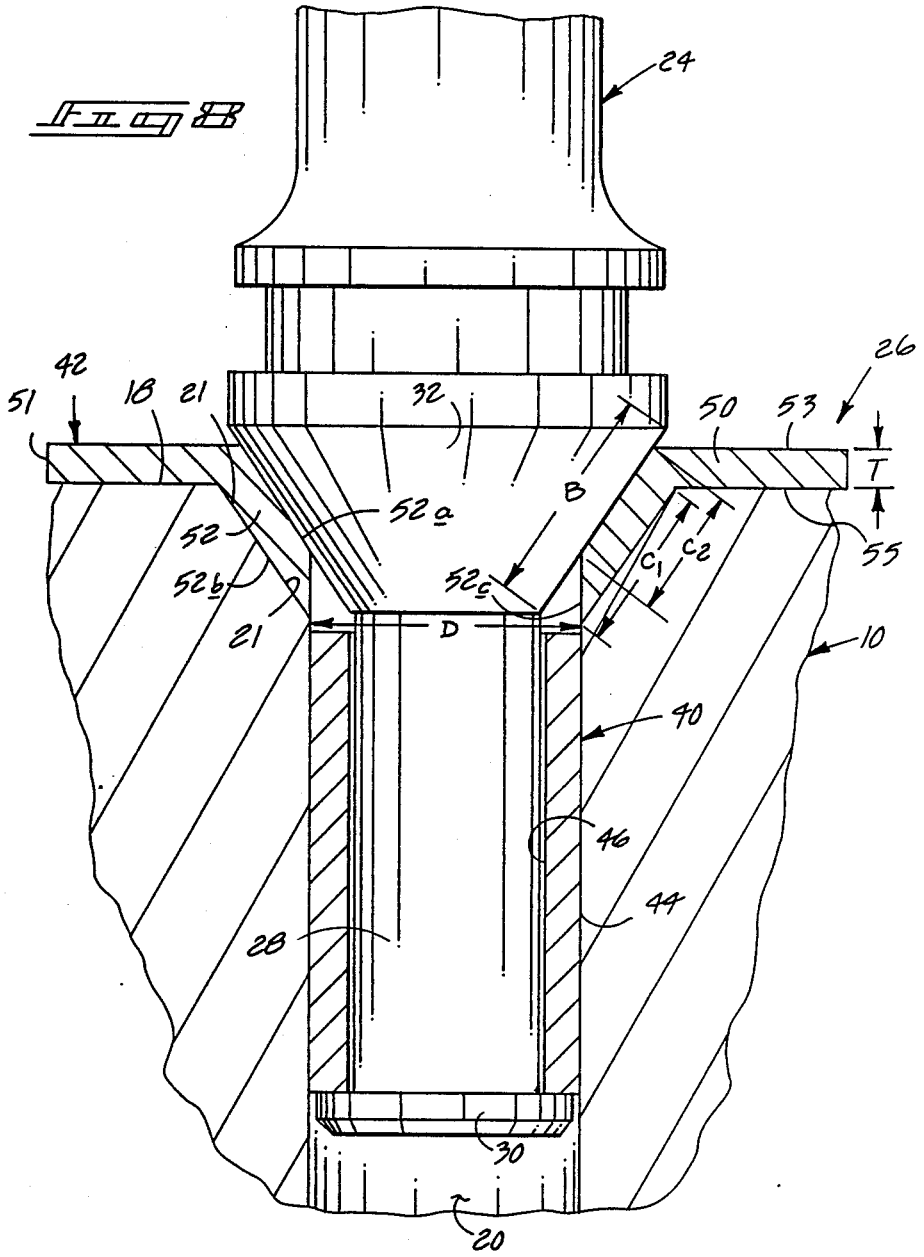
24
26
42
51
18
21
32
50
53
T
B
52a
52
52b
52c
C1
C2
55
21
D
10
40
46
44
28
30
20

WEAR PROTECTOR FOR TOOTH BRACKETS ON ROADWAY SURFACE CUTTING MACHINES

RELATED INVENTIONS

This is a continuation-in-part of U.S. patent application Ser. No. 076,544 filed July 21, 1987 now abandoned.

TECHNICAL FIELD

The present invention relates to wear protection of mounting brackets that releasably secure surface removal wear teeth mounted on a rotatable surface cutting machine.

BACKGROUND OF THE INVENTION

Specially designed wear teeth are used in surface removal machines, such as those for removing roadway surfaces. This form of machine generally make use of a rotating cylinder ("mandrel") having spiral flights along the peripheral surface. A plurality of the wear teeth or bits are mounted to the flights by releasable brackets which orient the teeth for engaging and cutting through roadway surface as the mandrel rotates. The teeth are typically removable from the brackets to enable replacement when they become excessively worn. The brackets, in turn, can also be removed from the mandrel flight for replacement when worn.

Efforts have been made to extend the useful life of wear teeth. For example, teeth with cylindrical shanks are commonly mounted in the brackets with locking sleeves within which the teeth are able to rotate. A freely rotatable tooth will not constantly expose a single surface to wear. Instead, the tooth will wear evenly about the periphery of its cutting point as it rotates responsive to rotation of the mandrel and cutting action against the surface to be removed.

The support brackets that mount the teeth also wear significantly and require periodic replacement, though not nearly as frequently as the wear teeth. Replacement of brackets, unlike tooth replacement, requires substantially more "down time" for the equipment. It is a time-consuming and labor-intensive chore to remove and replace brackets, especially those that have been welded in place on the mandrel flights. It is therefore desirable to protect the brackets in a way that will extend their useful life and consequently reduce equipment down time.

My U.S. Pat. No. 4,561,698 discloses a device which can significantly extend the life of the brackets. That patent discloses a bushing and wear protector having an annularly extending flange which covers and protects exposed surfaces of the bracket. Protection of these surfaces reduces bracket wear due to impact and abrasion from the material being removed, and from abrasion and impact from the wear tooth itself. The protector is constructed to wear at approximately the same rate as the tooth, so both the protector and tooth can be replaced at the same interval. My present invention is an improvement upon the inventive concepts disclosed in my U.S. Pat. No. 4,561,698.

BRIEF DESCRIPTION OF THE DRAWINGS

Preferred forms of the present invention are illustrated in the accompanying drawings, in which:

FIG. 1 is a perspective view of a conventional prior art bracket useful for mounting wear teeth to roadway surface repair vehicles;

FIG. 2 is a perspective view of the same bracket shown after a wear period using standard cutting teeth;

FIG. 3 is a sectional view through a bracket showing a bushing and wear protector apparatus in accordance with the invention in place mounting a wear tooth to a bracket;

FIG. 8 is an enlarged sectional view of the embodiment shown in FIG. 7, assembled and installed in a fragmented portion of a bracket to show preferred dimensional relationships thereof with the bracket and wear tooth.

DETAILED DESCRIPTION OF THE PREFERRED AND ALTERNATE EMBODIMENTS

Figure 5:
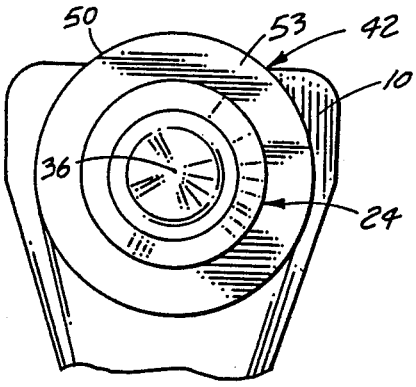
FIG. 5 is an end elevation view of the bushing and wear protector apparatus of FIG. 3.

The following disclosure of the invention is submitted in compliance with the constitutional purpose of the Patent Laws "to promote the progress of science and useful arts" (Article 1, Section 8).

The present invention is described herein for use with a roadway surface removal machine. This use is exemplary, it being understood that uses with other forms of surface removal equipment, for example, drills, are also envisioned without requiring extensive modifications of the components described herein.

FIGS. 1–3 are illustrative of an existing form of a support bracket 10 of the type generally used in roadway profiling or pavement removal. The support bracket includes a relatively flat support or foot portion 12 that may be secured by appropriate fastening means, such as welding, to the flight of a rotatable mandrel 14 (FIG. 3).

Bracket 10 is constructed of hard steel and includes an upwardly inclined base end 16 that is spaced along an axis from a parallel angularly oriented face 18. An inclined socket or bore 20 extends through the bracket from an opening on angled face 18 to a coaxial opening on base end 16. Base end 16 and face 18 are spaced apart by peripheral bracket side edge surfaces 22. Bracket 20 also includes a flared surface 21 formed at the opening or mouth of socket 20 at angled face 18.

Referring to FIG. 3, socket 20 is adapted for receiving and mounting a bit or wear tooth generally indicated by reference numeral 24. Wear tooth 24 is carried by the present bushing and wear protector apparatus indicated generally by reference numeral 26. Bushing and wear protector 26 carries tooth 24 within socket 20 to project ahead of angled bracket face 18 for engaging and cutting through surface material.

Wear tooth 24 is substantially symmetrical about its longitudinal axis. It includes a substantially cylindrical elongated shank 28 leading axially from a shouldered butt end 30 to a flared shoulder portion 32. Shank 28 is generally complementary in shape and length to bracket socket 20. Flared shoulder 32 is complementary in shape to and is received by flared surface 21 of bracket 10 at the mouth of socket 20. Butt end 30 serves to hold the wear tooth along its axis and facilitate removal from the bracket by means of a hammer and punch, as will become more readily apparent from the continuing discussion. The remainder of tooth 24 extends axially from tooth shoulder 32 to a wear point 36 (FIG. 3). Wear point 36 is typically formed to a hard, conical shaped surface and is constructed of carbide steel. The remainder of the tooth is typically formed from a softer, mild steel.

FIG. 2 illustrates a worn bracket 10a. The original face 18 has been worn away as has the original flared surface 21 that originally joined angled face 18 with socket 20. A surface 21*a* which is somewhat similar to surface 21 is apparent deep within socket 20. However, the surface has been gradually deepened by successive wear teeth impacting the roadway surface. The ever deepening socket produces an uneven setting for teeth 24 and will eventually necessitate replacement of the brackets. Furthermore, worn surfaces 38 about angled face 18 eventually weaken the material surrounding tooth shank 20 and increase the possibility of breakage along bracket socket 20.

In general, the present bushing and wear protector apparatus 26 which supports tooth 24 includes a first member 40 and a second member 42. First member 40 is in the form of an elongated split spring locking sleeve member which rotatably receives wear tooth shank 28. First member 40, alternately spring sleeve 40, is substantially equal in length to the tooth shank 28 and is removably received securely within bracket socket 20. It includes an external surface 44, which releasably grips bracket 10 from within socket 20, and an internal surface 46. The outside diameter of sleeve 40 defined by external surface 44 is normally slightly greater than the inside diameter of bracket socket 20.

Sleeve 40 is longitudinally split along a jagged axial fissure 48 to facilitate crimping of the sleeve along its length to be driven easily into and out of a bracket socket 20. The spring tension in spring sleeve 40 will press external surface 44 of the sleeve against the walls of socket 20 and thereby firmly hold the sleeve within slot 20 with a press fit. The diameter of the internal surface 46, even when compressed, loosely encompasses tooth shank 28 to facilitate free rotational movement of the tooth 24 therein about the longitudinal tooth axis. Enlarged butt end 30 of tooth 24 extends radially beyond the inside diameter of axial sleeve 40 preventing removal of the tooth from the bushing and bracket. The sleeve 40 bears against the butt end 30 and holds the tooth 24, but permits the tooth 24 to freely rotate within the sleeve 40.

In general, second member 42, alternately annular flange member 42, is fitted axially adjacent and extends radially outward relative to elongated spring locking sleeve 40. Second member 42 includes an annular flange portion 50 adapted for overlapping bracket face 18 to prevent wear of bracket 10 about bracket tooth receiving socket 20.

The annular flange portion 50 extends substantially radially outward to a circular peripheral edge 51. Flange portion 50 includes an axial forwardly facing surface 53 and a parallel rearward surface 55. Rearward surface 55 is adapted to be received in flush engagement with angled bracket face 18. Surface 55 overlaps the bracket face 18 to the bracket side edge surfaces 22. With such a construction, forwardly facing surface 53 is exposed to abrasion from material broken by tooth 24.

It is preferable that tooth 24 and bushing and wear protector apparatus 26 wear at the same rate so both will require replacement at the same time. This is advantageously achieved by forming the second flange member 42 for example by stamping the entire member 42 from spring steel. The steel blank stock is selected so the resulting second member 42 will advantageously include an overall predetermined minimum thickness dimension "T" of approximately 0.045 inch. It is preferred that the first member 40 be formed of the same material, though the forming process may differ from that used to form the second member 42. The first member may be formed instead by a rolling following a stamping or die cutting process.

Second member 42 further includes a preferably integral flared shoulder section 52 extending from flange portion 50 to a location adjacent sleeve 40. It is important to note that flared shoulder 52 is angled to compliment the similarly flared shoulder surface 21 of bracket socket 20. Flared shoulder 52 includes a forward facing conical surface 52*a* and a rearward facing conical surface 52*b*. Surface 52*a* receives the flared shoulder 32 of the wear tooth 24. Surface 52*b* frictionally engages the flared surface 21 of the bracket 10. The thickness dimension between surfaces 52*a* and 52*b* is substantially equal to the thickness dimension between surfaces 53 and 55 of the flange portion 50.

Flared shoulder 52 also defines a central opening 52*c*. Opening 52*c* is sized to be pressed or otherwise fitted over the butt end 30 of the wear tooth 24. The opening therefore preferably includes a diameter D (FIG. 8) that is preferably equal to the diameter of the butt end 30. The bottom edge of the shoulder is continuous about the opening 52*c*.

Flared shoulder 52 will receive the bulk of impact produced from tooth 24 at its shoulder 32 as point 36 is driven onto roadway surfaces. Shoulder 52 also accepts much of the abrasion created by the tooth as it rotates about its axis during use. Shoulder 52 therefore protects bracket shoulder surface 21 from becoming worn as indicated in FIG. 2.

Locking means is provided to prevent relative rotation of the second member 42 on the bracket 10, while enabling relatively free rotation of the tooth 24 therein. This is done to prevent abrasion between the second member 42 and bracket 10.

Figure 7:
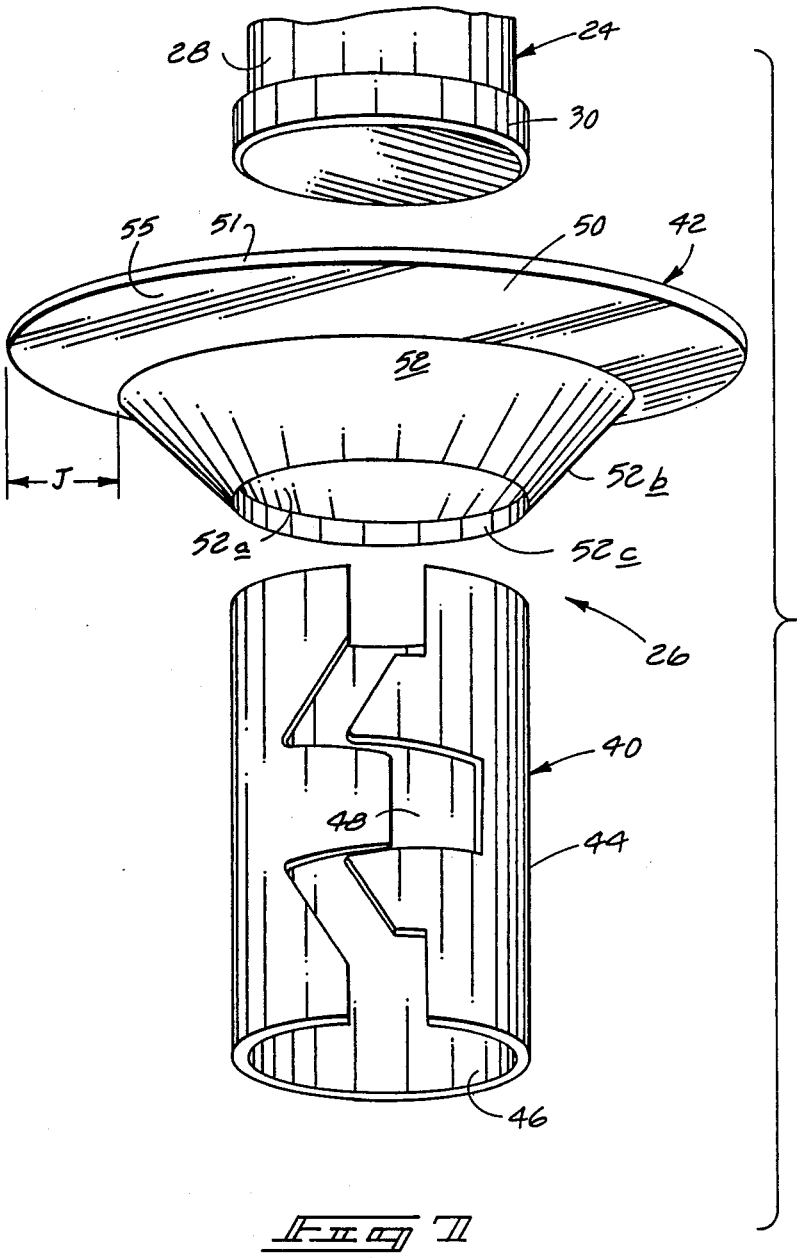
FIG. 7 is an exploded perspective view of a bushing and wear protector embodiment.

The locking means is provided in the embodiment illustrated in FIGS. 7 and 8 by particular features of the second member 42. Firstly, the flange portion 50 of second member 42 is provided for maximum frictional contact with the face 18 of the bracket. Specifically, the flange portion 50 includes a radial dimension along its rearward face surface 55 sufficient to situate the outward flange edge 51 adjacent to the bracket side edge surface 22. Surface 55 thus provides maximum frictional contact between the rearward flange surface 55 and bracket face 18, to discourage rotation of the second member on the bracket. To this end, a minimal radial dimension of 0.300, indicated by distance "J" in FIG. 7 is preferred for the flange surface 55 extending between the rearward surface 52*b* of flared shoulder section 52 to the edge 51.

Another feature of the second member that contributes to the locking function in the FIG. 7, 8 embodiment is an intimate high friction contact between the rearward surface 52*b* of flared shoulder section 52 and the flared surface 21 of the bracket bore. It is advantageous to maintain maximum contact between these surfaces, yet provide sufficient clearance through the central opening 52c of the member 42 to facilitate its placement over the butt end 30 of the tooth shank 28. To this end it has been found that the dimension "$C_1$" of the flared shoulder surface 52b should be approximately equal to the corresponding dimension of the bracket shoulder 21. Further, the opposite surface 52a should have a dimension "$C_2$" that is at least 65% and preferably about 70% of the dimension "B" of the flared shoulder 32 of the tooth 24.

A shoulder 52 having these dimensional properties provides several distinct advantages.

Firstly, it facilitates a maximum abutment surface contact between the flared surface 21 of the bracket 10 and the mating rearward surface 52b of the flared shoulder 52 to minimize bracket wear. Additionally the frictional contact surface area 18 of the bracket, engaged by surface 55 of the second member is much larger than the tooth flange area 32 engaged by surface 52b of the second member 42. Thus, rotation of the tooth 24 is not likely to cause corresponding rotation of the second member 42.

Secondly, the conical shape of the large surface areas 52b also serves in a "wedging" capacity, binding surface 52b against the bracket responsive to rearward thrust of the wear tooth during operation. Such binding action further inhibits rotation of the member 42 relative to the bracket 10.

Thirdly, the smaller surface 52a provides minimal effective contact between the flared shoulder 52 and the mating flared shoulder 32 of the tooth 24. Such minimal contact reduces friction and enables rotation of the tooth. Yet the relationship of surface dimension "$C_2$" to the tooth shoulder dimension "B" is such that wear of the member 42, due to frictional contact between the surfaces 32 and 52a will substantially equal that of the wear tooth 24.

With the above, resistance to rotation as between the bracket 10 and second member 42 is maximized at the same time that resistance to rotation as between the tooth 24 and the second member 42 is minimized. All this is accomplished while maintaining a wear rate of the second member substantially equal to that of tooth 24.

A still further distinct advantage brought about by the relationships discussed above is that the wear tooth 24 will seat within the bracket with its wear point 36 projecting forwardly from the forward surface 53 by a distance substantially equal to the point projection distance from the bracket face 18 when the present wear protector is not used. This provision has special significance in operation.

The wear tooth and bracket are designed to withstand both axial and lateral stresses. In operation, lateral stress on the shank 28 increases with the distance from the bracket to the wear point. The present second member 42 allows for maximum contact with the wear tooth shank but with minimum extension of the tooth point from the bracket. This is accomplished through provision of the flared shoulder 52, receiving the tooth shoulder 32 within the bracket 10. Thus lateral stress and consequent wear between the shank 28 and adjacent surfaces of the bracket 10 are minimized through provision of the present invention.

Figure 4:
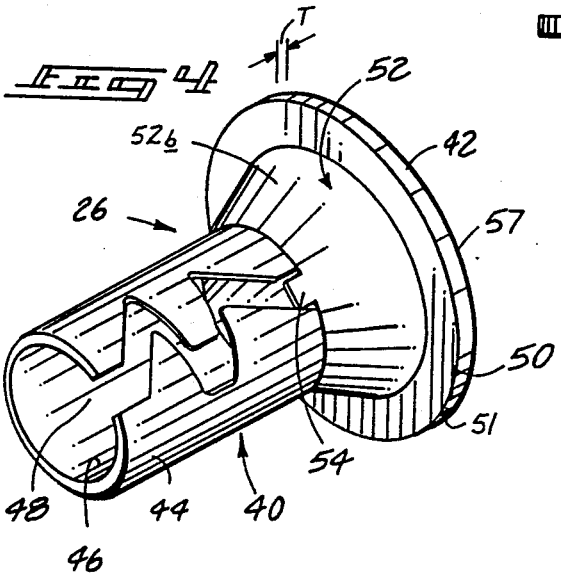
FIG. 4 is a perspective view of the bushing and wear protector apparatus of FIG. 3.
Figure 6:
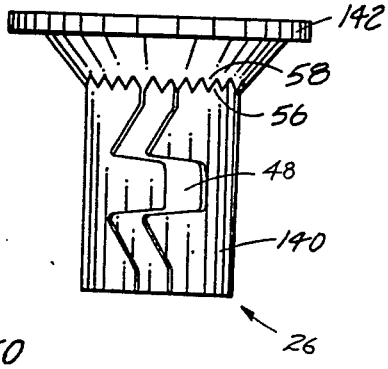
FIG. 6 is a side elevation view of another embodiment bushing and wear protector apparatus in accordance with the invention.

Alternative, additional locking means are provided in the embodiments shown in FIGS. 4 and 6 for preventing rotation of the first and second members 40, 42 relative to one another and to the bracket. On both embodiments the locking means advantageously comprises in addition to the flared shoulder 52 and flange 50, (1) the diameter of sleeve 40 being greater than the diameter of socket 20. This provides an outward spring biasing force against the walls of socket 20 which restrains sleeve 40 from rotation; and (2) interconnecting means which couple the first and second members together. FIG. 4 illustrates the interconnecting means as being in the form of an interlocking projection 54 which extends downwardly from flared shoulder section 52 of second member 42. Interlocking projection 54 engages sleeve 40 by extending into axial fissure 48. Such a construction in addition to the features described above for the embodiment shown in FIGS. 7 and 8, prevents first member 40 and second member 42 from rotating relative to one another and to the bracket 10.

FIG. 6 illustrates an embodiment of the present wear protector assembly 26 having interconnecting means comprised of a plurality of matingly received interlocking discontinuities which are formed in adjoining edges of each of first and second members 140, 142. Such interlocking discontinuities are shown in the form of serrated edges 56, 58 forming teeth-like projections and valleys on a sleeve 140 and annular flange member 142 which engage one another.

In all embodiments shown, the entire assembly including wear protector 26 and wear tooth 24 are mounted to a bracket 10 by driving the tooth and protector assembly into socket 20 with a soft headed mallet or hammer. The second member will seat itself firmly against the flared surface 21 of the bracket and the bracket face 18. Removal is accomplished by hammering a punch against butt end 30 of shank 28 to drive the tooth assembly from the socket 20.

A significant advantage is realized when installing a wear tooth 24 with the present two piece construction of the brushing and wear protector 26. With the flared shoulder 52 as an integral part of the second member, separate from the first member, wedging action of the tooth shoulder 21 as it is driven into the bracket is isolated in the second member 42 and will not be transmitted to the first member 40. The tooth shoulder 21 thus will not have a tendency to open the first member against the walls of the socket, binding the first member in the socket to the point where installation becomes extremely difficult. Installation is accomplished easily with the first member being allowed to expand and contract independently of the second member.

There is further signficant manufacturing advantage in employing a two piece bushing and wear protector as opposed to an integral one piece connector of the invention of my U.S. Pat. No. 4,561,698. The manufacturing costs associated with stamping the integral, one piece bushing and wear protector apparatus are much higher than separately shaping two pieces which assemble to form the desired shape. Significant savings are obtained in manufacturing a multi-piece, assemblable bushing and wear protector.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A bushing and wear protector apparatus for mounting a roadway surface removal wear tooth to a support bracket, the wear tooth including an elongated shank formed along a central axis and leading axially from a butt end to a flared shoulder, and further including a wear tip extending axially from the tooth shoulder to a pointed end, the bracket including a shank receiving socket, a flared shoulder at a forward end of the socket, and a bracket face encircling the socket and flared shoulder, the bracket face extending to peripheral bracket side edges, the apparatus comprising:

a first member having a length dimension substantially equal to the length of the wear tooth shank between the butt end and the flared shoulder thereof and adapted to rotatably receive the wear tooth shank and to be removably received securely within the bracket socket;

a second member independent of the first member and having a continuous annular flared shoulder portion with a central opening at one end adapted to be received over the butt end of the wear tooth, a forward surface adapted to rotatably receive the flared shoulder of the wear tooth and a rearward surface adapted to be received by the flared shoulder of the bracket face with the one end axially adjacent the first member;

the second member further including a continuous annular flange extending from the flared shoulder portion to a peripheral edge, the flange including a rearward surface adapted to frictionally engage and substantially cover the bracket face to the peripheral bracket side edges and a forward surface spaced from the rearward surface to prevent wear of the bracket face; and locking means for preventing rotation of the first and second members relative to one another and the bracket.

2. The bushing and wear protector apparatus of claim 1 wherein the locking means includes the rearward surfaces of the flared shoulder and annular flange of the second member, the rearward surfaces being adapted for flush engagement with the face and flared shoulder of the bracket.

3. The bushing and wear protector apparatus of claim 1 wherein the locking means comprises at least one projection extending from the second member.

4. The bushing and wear protector apparatus of claim 3 wherein the projection extends from the flared shoulder section and engages the first member.

5. The bushing and wear protector apparatus of claim 4 wherein the first member comprises an elongated spring locking sleeve which is at least partially longitudinally split along a fissure, the projection extending from the second member being received by the fissure.

6. The bushing and wear protector apparatus of claim 1 wherein the locking means includes the rearward flared shoulder surface of the second member which includes an axial surface dimension ("$C_2$") that is adapted to be approximately 70% of a corresponding axial surface dimension ("B") of the wear tooth flared shoulder.

7. The bushing and wear protector apparatus of claim 6 wherein the locking means includes the inward flared shoulder surface of the second member which includes an axial surface dimension ("$C_1$") adapted to be substantially equal to a complementary surface dimension of the bracket flared shoulder.

8. The bushing and wear protector apparatus of claim 1 wherein the locking means comprises at least one interlocking discontinuity formed in each of the first and second members, the at least one interlocking discontinuity of the first member being matingly received by the at least one interlocking discontinuity of the second member.

9. The bushing and wear protector apparatus of claim 8 wherein the discontinuity is comprised of serrated edges formed on each of the first and second members, said serrated edges being matingly received by one another.

10. The bushing and wear protector apparatus of claim 1 wherein the second member includes a dimension between the forward and rearward surfaces of approximately 0.045 inches.

11. In a bracket and wear tooth assembly including a bracket having a bracket face oriented transversely to an open tooth receiving socket and a wear tooth having a wear tip and an elongated shank to be received within the socket, a bushing and wear protector comprising:

an elongated axially split spring locking sleeve member for rotatably receiving the wear tooth shank, the sleeve having an external surface for releasably gripping the bracket from within the socket and further having an internal surface extending along substantially the full length of the elongated wear tooth shank for retaining the wear tooth within the socket while allowing free rotation thereof;

an annular flange member axially adjacent to and independent of the sleeve, the flange member having a flared shoulder portion with a central opening loosely receiving the wear tooth shank within the socket and axially adjacent the spring locking sleeve and an annular flange portion extending radially outward relative to the sleeve external surface to overlap the bracket face to prevent wear of the bracket about the tooth receiving socket; and locking means for preventing rotation of the annular flange member and elongated spring locking sleeve member relative to one another.

12. The bushing and wear protector apparatus of claim 11 wherein the locking means comprises interconnecting means for coupling the sleeve member and flange member together.

13. The bushing and wear protector apparatus of claim 12 wherein the interconnecting means comprises at least one interlocking discontinuity formed in each of the sleeve and flange members, the at least one interlocking discontinuity of the one member being matingly received by the at least one interlocking discontinuity of the remaining member.

14. The bushing and wear protector apparatus of claim 11 wherein the locking means comprises at least one interlocking projection extending from the flange member.

15. The bushing and wear protector apparatus of claim 11 wherein the annular flange portion and flared shoulder portion include rearward surfaces shaped for flush engagement with the bracket and wherein the locking means is comprised of said rearward surfaces.

16. An annular wear protective flange member and spring locking sleeve for a wear having an elongated shank formed along a central axis and leading from a butt end to a flared shoulder, the shank and shoulder being receivable within a shank receiving socket and flared shoulder of a bracket; the wear protective flange member and spring locking sleeve comprising:

a continuous annular flared flange shoulder portion having: a central opening adapted to be received axially over the elongated shank; a forward surface adapted to slidably engage the flared shoulder of the wear tooth and a rearward surface adapted to conform with and frictionally engage the flared shoulder of the bracket;

said continuous annular flared flange shoulder portion including an axial dimension substantially equal to corresponding axial dimension of the flared shoulder of the wear tooth;

a continuous annular flange portion integral with and extending from the flared flange shoulder portion to a continuous peripheral edge and having: a rearward surface thereon adapted to overlap and frictionally engage the bracket; a forward wear surface spaced from the rearward surface; and a continuous peripheral edge located outwardly of the flared flange shoulder;

wherein the rearward surfaces of the flared flange shoulder portion and the annular flange portion are adapted to frictionally engage the bracket to resist rotation of the wear protective flange member about the central axis, relative to said bracket when the wear tooth is received within the shank receiving socket of the bracket;

wherein the spring locking sleeve is comprised of a spring member of substantially tubular configuration having an open axial fissure along an axial length dimension between ends, said length dimension being substantially equal to the axial shank dimension between the butt end and flared shoulder thereof; and wherein the annular wear protective flange and the spring locking sleeve are axially receivable over the wear tooth from the butt end thereof with the spring locking sleeve and wear protective flange axially adjacent and substantially spanning the tooth length including the shank and the flared shoulder thereof.

17. The flange member of claim 16 wherein the forward surface of the flared flange shoulder includes an axial dimension less than a corresponding dimension of the rearward surface.

18. The flange member of claim 17 wherein the annular flange portion and flared flange portion includes a thickness dimension of approximately 0.045 inches.

19. The flange member of claim 16 wherein the annular flange portion and flared flange portion includes a thickness dimension of approximately 0.045 inches.

* * * * *